US009133807B2

(12) United States Patent
Yudanov

(10) Patent No.: US 9,133,807 B2
(45) Date of Patent: Sep. 15, 2015

(54) FLOW CONTROL SYSTEM

(75) Inventor: Sergi Yudanov, Västra Frölunda (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 14/409,257

(22) PCT Filed: Aug. 8, 2012

(86) PCT No.: PCT/EP2012/003382

§ 371 (c)(1),
(2), (4) Date: Dec. 18, 2014

(87) PCT Pub. No.: WO2014/023317

PCT Pub. Date: Feb. 13, 2014

(65) Prior Publication Data

US 2015/0176555 A1 Jun. 25, 2015

(51) Int. Cl.

| | |
|---|---|
| ***F02M 63/02*** | (2006.01) |
| ***F02M 37/00*** | (2006.01) |
| ***F02M 47/02*** | (2006.01) |
| ***F02M 63/00*** | (2006.01) |

(52) U.S. Cl.

CPC ..... *F02M 63/0049* (2013.01); *F02M 37/0023* (2013.01); *F02M 37/0029* (2013.01); *F02M 47/02* (2013.01); *F02M 63/0029* (2013.01); *F02M 63/0033* (2013.01); *F02M 63/0043* (2013.01); *F02M 63/0045* (2013.01)

(58) Field of Classification Search

CPC ..... F20M 37/0023; F20M 37/0029; F20M 47/02; F20M 47/025; F20M 63/0225

See application file for complete search history.

(56) References Cited

U.S. PATENT DOCUMENTS

| | | | | |
|---|---|---|---|---|
| 4,019,481 | A * | 4/1977 | Lakra | 123/447 |
| 5,622,152 | A * | 4/1997 | Ishida | 123/446 |
| 5,878,720 | A * | 3/1999 | Anderson et al. | 123/496 |
| 6,675,773 | B1 * | 1/2004 | Mahr et al. | 123/446 |
| 7,549,410 | B2 * | 6/2009 | Yudanov | 123/506 |
| 2006/0196474 | A1 * | 9/2006 | Magel | 123/446 |

FOREIGN PATENT DOCUMENTS

| | | | |
|---|---|---|---|
| JP | 2011202545 | A | 10/2011 |
| WO | 2007046733 | A1 | 4/2007 |

OTHER PUBLICATIONS

International Search Report (Apr. 17, 2013) for corresponding International Application PCT/EP2012/003382.

* cited by examiner

*Primary Examiner* — Ryan Reis
(74) *Attorney, Agent, or Firm* — WRB-IP LLP

(57) ABSTRACT

A flow control system for a fuel injector for an internal combustion engine is provided and includes an inlet port, an outlet, a return port, a 2-way control valve including a control valve member, a shuttle valve and a main valve. The control valve includes a first seat, a first resilient arrangement configured to force the control valve member towards the seat so as to close the control valve, and a first abutment that limits the lift of the control valve member away from the first seat. The first seat of the control valve is slidably arranged in the shuttle control chamber. An end stop for the first seat is provided such that the pressure in a shuttle control chamber tends to move the first seat towards the end stop. The first seat, upon its mechanical contact with a valve member is able to transmit at least a part of the force of the resilient means onto a shuttle valve body in the opening direction of the shuttle valve.

18 Claims, 6 Drawing Sheets

FLOW CONTROL SYSTEM

BACKGROUND AND SUMMARY

This invention relates to a flow control system, in particular for a fuel injector for an internal combustion engine.

In fluid power applications, flow control systems are important constituents that directly define accuracy, reliability, efficiency and cost of the device/installation they belong to. Correspondingly, a flow control system must consume a minimum of energy to control the given fluid power, while being inexpensive, simple, reliable and durable and fulfilling the necessary control accuracy demands. One example of an especially demanding application for a flow control system is a diesel fuel injector. Contemporary diesel fuel injection systems of, for instance, a heavy-duty truck engine are required to deliver high hydraulic power in extraordinarily short bursts with an almost unthinkable accuracy: an instantaneous fluid power in the order of 40 kW can be routinely achieved, its delivery precisely controlled and then fully terminated, all within about 1 ms time slot or less. A fuel injector must keep doing this for up to a billion cycles safely and efficiently while retaining as good controllability as ever over its lifetime. At the same time, being a significant contributor to the overall cost of the engine, the fuel injector is receiving correspondingly high cost reduction attention. It must also be energy efficient, in order for the engine as a whole to attain good fuel economy, whilst affording sufficiently good controllability to allow efficient and clean combustion of the fuel.

Trying to fulfil such a great multitude of conflicting demands, a correspondingly great number of different fuel injectors and their flow control systems have been suggested. However, even the best of the prior art systems have certain drawbacks. For example, the flow control systems that utilize a 3-way solenoid actuator, while benefiting from the advantages this may give in terms of control precision, have a relatively high cost and complexity associated with that actuator, making this approach feasible only for a very few select manufacturers but also carrying their own particular durability and efficiency concerns. Other flow control systems, such as the one disclosed in JP2011202545, are based on a simpler 2-way solenoid actuator and are thus cheaper and may be more durable, but at the same time these tend to have a relatively high control leakage in the hydraulic circuit that amplifies the primary controller's commands and therefore require extremely tight tolerances in order to stay relatively efficient. In addition, this kind of prior art flow control systems/injectors require a compromise to be made between the hydraulic efficiency (the rate of control leakage) and the response time, especially that associated with the closure of the valve/end of injection.

It is desirable to provide a flow control system where the previously mentioned problems are at least partly avoided. According to an aspect of the present invention, a flow control system comprises:

an inlet port for receiving a fluid having a relatively high pressure, an outlet for letting out said pressurized fluid, a return port for returning part of said fluid to a volume having a relatively low pressure, a 2-way control valve comprising a control valve member, a first seat, a first resilient means configured to force said control valve member towards said seat so as to close said control valve, and a first abutment that limits the lift of said control valve member away from said first seat, a main valve comprising a main valve member, a second seat, a main control chamber, and an outlet chamber in fluid connection with said inlet port, said main valve member being configured to be forced by pressure in said main control chamber towards said second seat so as to close an opening to said outlet, a shuttle valve comprising a shuttle valve body, a shuttle control chamber and a third seat, said shuttle valve body being configured to engage with said third seat so as close an opening between said inlet port and said main control chamber;

a connection channel configured to connect said shuttle control chamber with said main control chamber, wherein said control valve is configured to close and open a connection between said shuttle control chamber and said return port and is biased towards its closed position by said first resilient means, said shuttle valve is biased closed by a second resilient means, said main valve is configured to open and close a connection between said inlet port and said outlet and is biased closed by said second resilient means, further wherein said shuttle valve is configured such that the pressure in said shuttle control chamber tends to open the shuttle valve whereas the pressure in said main control chamber tends to close the shuttle valve, wherein said main valve is configured such that said pressure in said main control chamber tends to close the main valve whereas a pressure in said outlet chamber tends to open the main valve, wherein said first seat of said control valve is slidably arranged in said shuttle control chamber and wherein an end stop for said first seat is provided such that the pressure in said shuttle control chamber tends to move said first seat towards said end stop, further wherein said first seat, upon its mechanical contact with said valve member, is able to transmit at least a part of the force of said resilient means onto said shuttle valve body in the opening direction of said shuttle valve.

As mentioned above in the discussion of the prior art, in flow control systems based on the use of a simple two-way control valve coupled to a hydraulic amplification stage to handle the throughput of the high hydraulic power, there is a conflict between the controllability of the flow control system and its hydraulic efficiency. This is because in prior art systems tuned for a quicker and more precise response to the control commands, a higher rate of control flow is required for faster re-pressurization of a hydraulic control chamber and development of a sufficient force to actuate valves. That higher rate of control flow usually entails also a higher rate of control leakage and, as a consequence, worse hydraulic efficiency of the entire system and other undesirable effects such as for example excessive fluid heat-up.

By extending the action of the mechanical resilient means of the control valve also to the shuttle valve, which is a part of the hydraulic amplification unit, a higher rate of leakage can be prevented. That extended action of the resilient means replaces the control flow that is otherwise necessary to initially re-pressurize the control chamber of the shuttle valve upon the flow control system's deactivation command, and thereby reduces the system's control leakage whilst achieving quick control response.

The slidable seat of the control valve may be precision-matched to its guide for limiting the leakage from the shuttle control chamber to the return port that bypasses the actual sealing surface of said seat and the control valve. The slidable seat may be further provided with an additional seating surface at its end stop that limits its movement away from the shuttle valve, such that when at the end stop, that seating surface would form a positive seal with the shuttle control chamber to completely prevent the seat bypass leakage. The shuttle valve may be provided with a differential area exposed to the pressure in the inlet port, in order to improve the force balance occurring on the valve and further shorten the response time to the command for terminating the controlled flow. Another enhancement of the flow control system may be embodied in the form of a poppet attached to the shuttle control valve between its seat and the main control chamber which may also be advantageously configured with a poppet restriction which replaces said fixed restriction between the main control chamber and the shuttle control chamber. By this means, the dynamic behaviour of the shuttle valve may be further improved for greater responsiveness, because the poppet restriction would help creating a positive pressure difference between the shuttle control chamber and the main control chamber and, at the same time, act to increase the effective area for the pressure in the shuttle control chamber and thereby facilitate a faster opening of the shuttle control valve to shorten the response time to the commands for terminating the controlled fluid flow.

According to an aspect of the invention, the flow control system may also include a fuel injection nozzle for additional trimming of the system's flow control characteristics. Said injection nozzle may be connected by its inlet to the outlet of said main valve and may be of a spring-closed type thus providing a faster flow rise and flow drop at correspondingly the flow initiation and termination commands to the flow control system. Said nozzle may be configured to have a needle biased closed by a needle spring, and a needle control chamber, wherein a positive pressure in the needle control chamber biases the needle towards closing the nozzle. The main control chamber of the flow control system may be hydraulically connected to this needle control chamber for a modified control characteristic of the system. Alternatively, the shuttle control chamber may also be hydraulically connected to the needle control chamber, to obtain a slightly slower start of the controlled fluid flow and a slightly faster termination of that flow.

Another embodiment of the present invention may also include a spill valve connected between the high pressure outlet and the volume with a relatively low pressure, for affording the inventive flow control system with an additional possibility of controlling the flow characteristics and providing extra safety features. According to this embodiment, the opening of the spill valve after the termination of the controlled fluid flow through the flow control system would relieve residual pressure between the main control valve and the nozzle and thus prevent possible undesired leakage through the nozzle that might lose its hydraulic tightness due to wear or other damage.

Yet another embodiment may be configured for further improved hydraulic efficiency, by having the spill valve installed between the return port and the volume with a relatively low pressure and the high-pressure outlet connected to the inlet of the spill valve. In this embodiment, the spill valve is closed before the control valve is open to begin the controlled fluid flow. This reduces the leakage out to the volume with a relatively low pressure, and instead directs the pressure relieved by the control valve in the beginning of the system opening into the inlet of the nozzle, so that less hydraulic energy from the outlet chamber of the main control valve would then be used to pressurize the nozzle inlet volume.

BRIEF DESCRIPTION OF DRAWINGS

In the detailed description of the invention given below reference is made to the following figures, in which.

DETAILED DESCRIPTION

Various aspects of the invention will hereinafter be described in conjunction with the appended drawings provided to illustrate and not to limit the invention, wherein like designations denote like elements.

Figure 1:
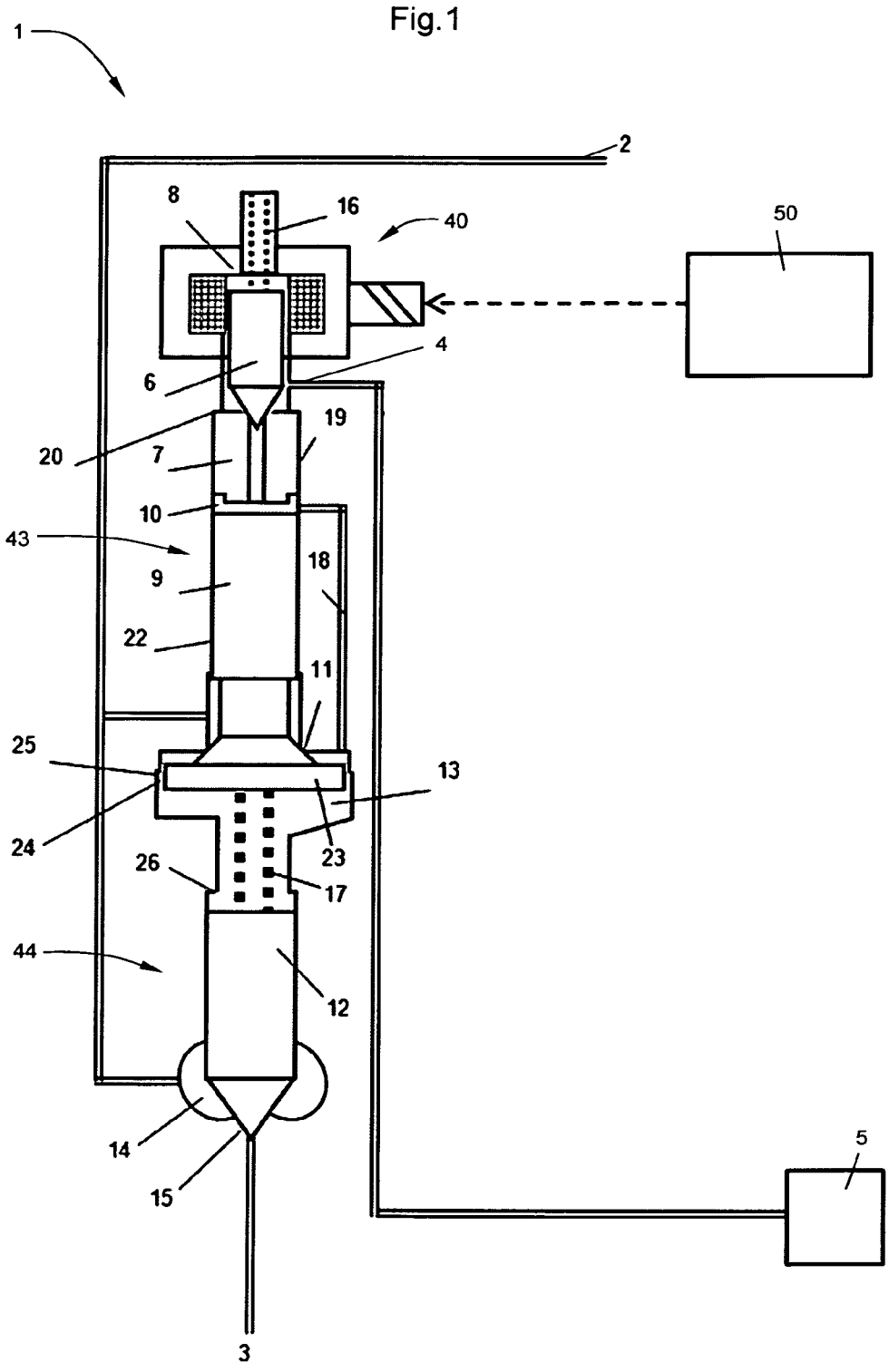
FIG. 1 schematically shows a flow control system according to a first embodiment of the invention, in one particular state of operating sequence.

FIG. 1 schematically shows a first embodiment of the flow control system 1 according to the invention. The system 1 comprises an inlet 2 for pressurized fluid, an outlet 3 for pressurized fluid, a return port 4 connected to a volume 5 having a relatively low pressure, a control valve 40 with a control valve member 6, a first seat 7 and a first abutment 8 that limits the lift of said control valve member 6 away from said first seat 7, a shuttle valve 43 with a shuttle valve body 9, 47, shuttle control chamber 10 and a third seat 11, and a main valve 44 with a main control chamber 13, an outlet chamber 14 and a second seat 15, wherein said control valve 40 is connected between the shuttle control chamber 10 and the return port 4 and is biased towards its closed position by a first resilient means 16, the shuttle valve 43 is connected between the inlet port 2 and the main control chamber 13 and is biased closed by a second resilient means 7. The main valve 44 is connected between the inlet port 2 and the outlet 3 and is biased closed by the second resilient means 17. The shuttle control chamber 10 is connected with the main control chamber 13 by a connection channel 18. The shuttle valve 43 is configured such that the pressure in the shuttle control chamber 10 tends to open the shuttle valve 41 whereas the pressure in the main control chamber 13 tends to close the shuttle valve 43. The main valve 44 is configured such that the pressure in the main control chamber 13 tends to close the main valve 44 whereas the pressure in the outlet chamber 14 tends to open the main valve 44. The first seat 7 of the control valve 40 is slidably arranged in the shuttle control chamber 10 and an end stop 20 for the first seat 7 is provided such that the pressure in the shuttle control chamber 10 tends to move the first seat 7 towards the end stop 20. The first seat 7, upon its mechanical contact with the control valve member 6, is able to transmit at least a part of the force of the resilient means 16 onto the shuttle valve body 9 in the opening direction of the shuttle valve 43.

In this embodiment, the end stop 20 and the first seat 7 have a seating surface that forms a hydraulic seal when the first seat is in contact with the end stop. The first seat 7 is preferably formed in the shape of a cylinder and is precision-matched to a corresponding guide surface 19 of the shuttle control chamber 10 for reduced leakage through the clearance between seat 7 and guide surface 19. As shown in the figures, the first seat 7 may be arranged with a stepped profile so as to ensure that the connection channel 18 is not overlapped during the movement of the first seat towards the shuttle valve body 9.

In a preferred embodiment of the invention, the shuttle valve 43 is provided with a differential area, defined by the diameters of the shuttle valve's guide 22 and the diameter of the third seat 11, the latter being greater than the former, such that positive pressure acting on the differential area would tend to open the shuttle valve towards said main control chamber 13. The shuttle valve 43 is also provided with a poppet 23 which is located between the third seat 11 and the main control chamber 13 in such a way that a hydraulic restriction 24 is formed between the poppet 23 and a wall profile 25 of the main control chamber 13 as shown in FIG. 1. The wall profile 25 is preferably configured such that said hydraulic restriction varies depending on the position of the shuttle control valve, and is at its maximum when the shuttle control valve is at or around its closed position.

In the initial position of the flow control system 1 as illustrated by FIG. 1, the control valve 6 is closed, the first seat 7 is pushed against the end stop 20 by the pressure in the shuttle control chamber 10 such that the leakage past the guide 19 is prevented by the hydraulic seal in the seating surface between the first seat 7 and the end stop 20. The shuttle valve 43 is held at its closed position on the third seat 11 by the second resilient means 17. The main valve 44 is held closed by the combined forces of the resilient means 17 and the pressure in the main control chamber 13, such that there is no fluid flow into the inlet port 2 nor out of the outlet 3 of the flow control system.

When a command is given, by a controller 50, to open the flow control system and allow controlled fluid flow from inlet port 2 to the outlet 3, the control valve member 6 is attracted towards its first abutment 8 and opens a flow path through the first seat 7. The pressure from the shuttle control chamber 10 is then relieved to the return port 4, also initiating a pressure relief in the main control chamber 13 as fluid flows from that chamber past the restriction 24 and channel 18 into the shuttle control chamber 10 and further out to the return port 4. During this time, the falling pressure in the main control chamber creates a valve opening force acting on the differential area of the shuttle valve 43, but this is counteracted by the positive pressure difference between the main control chamber 13 and the shuttle control chamber 10 that is created by the flow across the restriction 24, that acts on a relatively large area of the poppet 23. When the pressure in the main control chamber 13 falls sufficiently low compared to the pressure in the outlet chamber 14 of the main valve 44, the valve 44 opens and maintains the flow and the pressure difference across the restriction 24 as it moves into the main control chamber and displaces fluid from it, thereby keeping the shuttle valve 43 closed against pressure in the inlet 2 acting on the differential area of the valve. This allows the controlled pressurised fluid flow to the outlet 3. While the main valve 44 moves in the opening direction, it compresses the resilient means 17 which at its opposite end acts on the shuttle control valve body (9, 47) and thus increases the closing force on the shuttle control valve. By the time the main valve 44 reaches its lift stop 26, the force of the resilient means 17 increases enough to keep the shuttle valve 43 closed against the pressure acting on its differential area in the absence of the flow through, and the positive pressure drop across, the restriction 24. In this position of the flow control system, it is fully open to the pressurised fluid flow from the inlet port 2 to the outlet 3 whilst not relying upon or requiring/having any control flow, i.e. the flow of pressurised fluid out to the return port 4, to keep it in that position, and only being held in that open position by the open control valve 40, which is a simple two-way, low-power, inexpensive valve.

Figure 2:
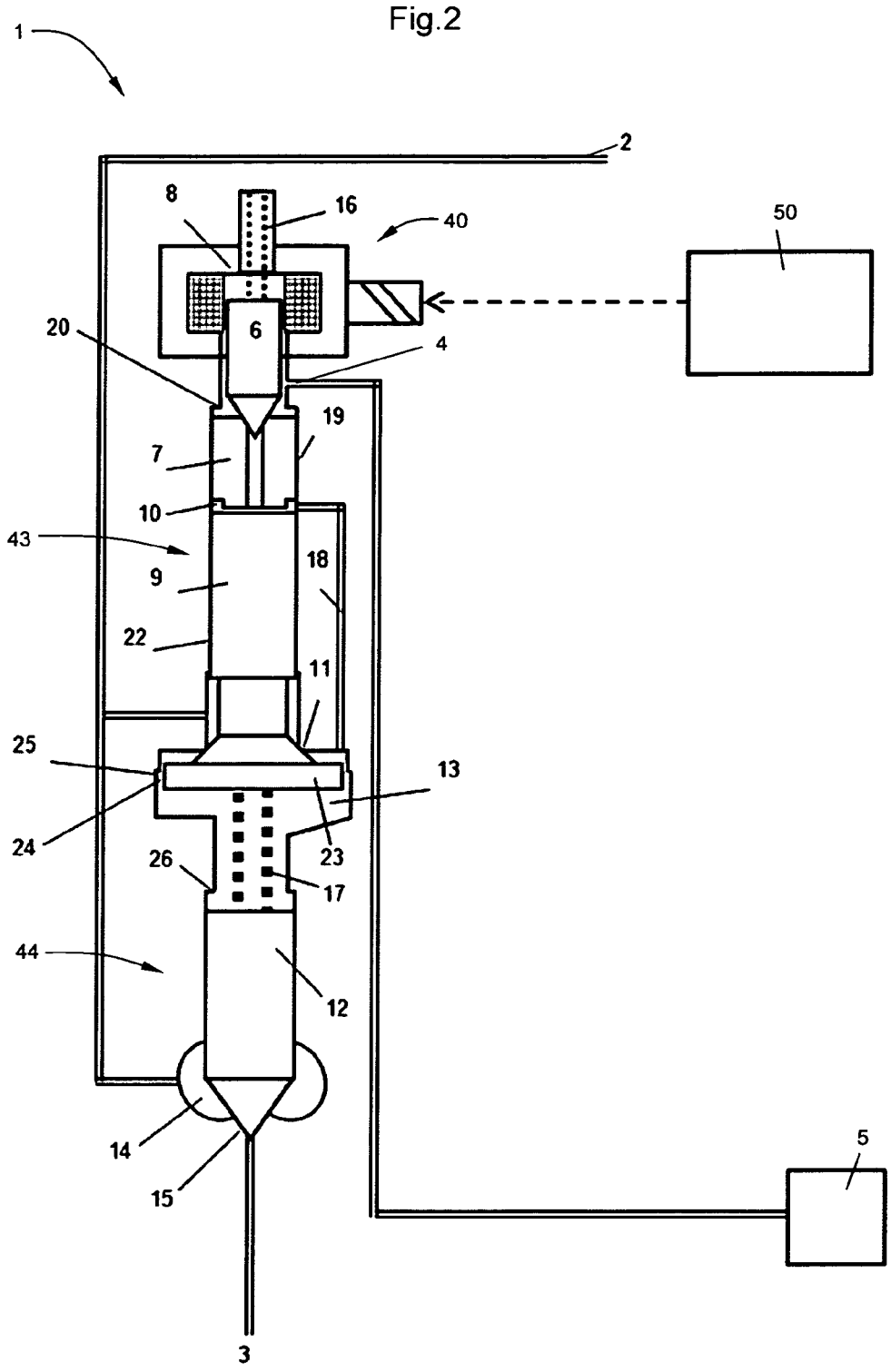
FIG. 2 schematically shows the first embodiment of the flow control system in another state of its operational sequence.

When a command is given to terminate the flow of pressurised fluid to the outlet 3, the control valve 40 is de-activated and its valve member 6 gets moved away from the first abutment 8 by the first resilient means 16, eventually engaging with the seat 7 and blocking the hydraulic connection between the shuttle control chamber 10 and the return port 4. Since the first seat 7 is slidably arranged in the guide 19, the force of the first resilient means 16, transmitted to the seat 7 upon contact with the control valve member 6, propels the seat into the shuttle control chamber 10 towards the shuttle valve body 9 and by means of this increases pressure in the shuttle control chamber, at the same time creating a positive pressure differential between the shuttle control chamber 10 and the main control chamber 13 with the help of the restriction 24 around the poppet 23. This state of the flow control system 1 is illustrated by FIG. 2. Said positive pressure differential, together with the force of pressure in the inlet port 2 acting on the differential area of the shuttle valve 43, overcomes the force of the resilient means 17 and provides an initial opening of the shuttle valve. With that, pressurised fluid flows past the third seat 11 and creates a larger pressure differential on the restriction 24, thereby quickly moving the shuttle valve 43 towards a more open position. At the same time, the rising pressure in the shuttle control chamber 10 moves the first seat 7 back into contact with the end stop 20, such that the available stroke of the control valve member 6 is re-set to the value designed for proper function of the solenoid, and the leakage past the guide 19 out to the return port 4 is completely stopped.

The opening of the shuttle valve 43 admits the pressurised fluid from the inlet port 2 into the main control chamber 13 via the restriction 24 which, upon increasing of the lift of the shuttle valve, diminishes and allows a faster re-pressurisation of the main control chamber. This, combined with the force of the second resilient means 17, eventually moves the main valve member 12 away from its lift stop 26 and closes it. Correspondingly, the flow of pressurised fluid to the outlet 3 terminates, and the pressures in the main control chamber 13, the shuttle control chamber 10 and the inlet port 2 equalize. Following this, the resilient means 17 moves the shade valve 43 towards its closed position, displacing fluid from the shuttle control chamber 10 back to the main control chamber 13 in the process and eventually returning the flow control system to its initial position as depicted in FIG. 1.

As described, the seat 7 of the control valve 40 is arranged with a possibility of sliding along its guide 19, and configured such that the positive pressure in the shuttle control chamber 10 forces the seat 7 away from the shuttle valve body 9 and against the end stop 20 functioning as the stroke limiter of the seat 7. During the time the flow control system 1 is in its initial position, the seat 7 of the control valve 40 is pushed against that end stop 20 by the pressure in the shuttle control chamber 10 that is essentially equal to the pressure at the inlet port 2 of the flow control system, such that the control valve 40 would function just as a typical control valve with a fixed stationary seat. The system does not have any intentionally provided flow control path for the high-pressure fuel to re-pressurize the control chambers and thus facilitate closing of the flow control system, which would have had to be led away to low-pressure return in order to keep the system open and would then have deteriorated the hydraulic efficiency. During the open state of the system, the shuttle valve 43 is held closed by the resilient means, such that no pressurized fuel is entering the volumes vented by the open control valve 40 and no leakage is created. When a command from the controller 50 to close the system is eventually received by the control valve 40, the piston 6 releases from its own abutment 8 and strikes the seat 7 in a closing action driven by the resilient means 16. The seat 7 will then act as a hydraulic piston to create a surge of pressure in the shuttle control chamber 10, of it may actually exert a mechanical force onto the body 9 of the shuttle valve 43, providing an initial impetus that re-opens the shuttle valve 43. In this way, the system can react quickly to the command for interrupting the high-pressure fluid flow whilst not requiring any parasitic flow that is necessary in the prior art systems for re-pressurization of control chambers and initiation of a flow termination sequence.

The embodiment shown in FIGS. 1 and 2 can for instance serve as a fuel injector of an internal combustion engine, wherein the inlet 2 is connected to a fuel common rail and the outlet 3 terminates in an injection orifice.

Figure 3:
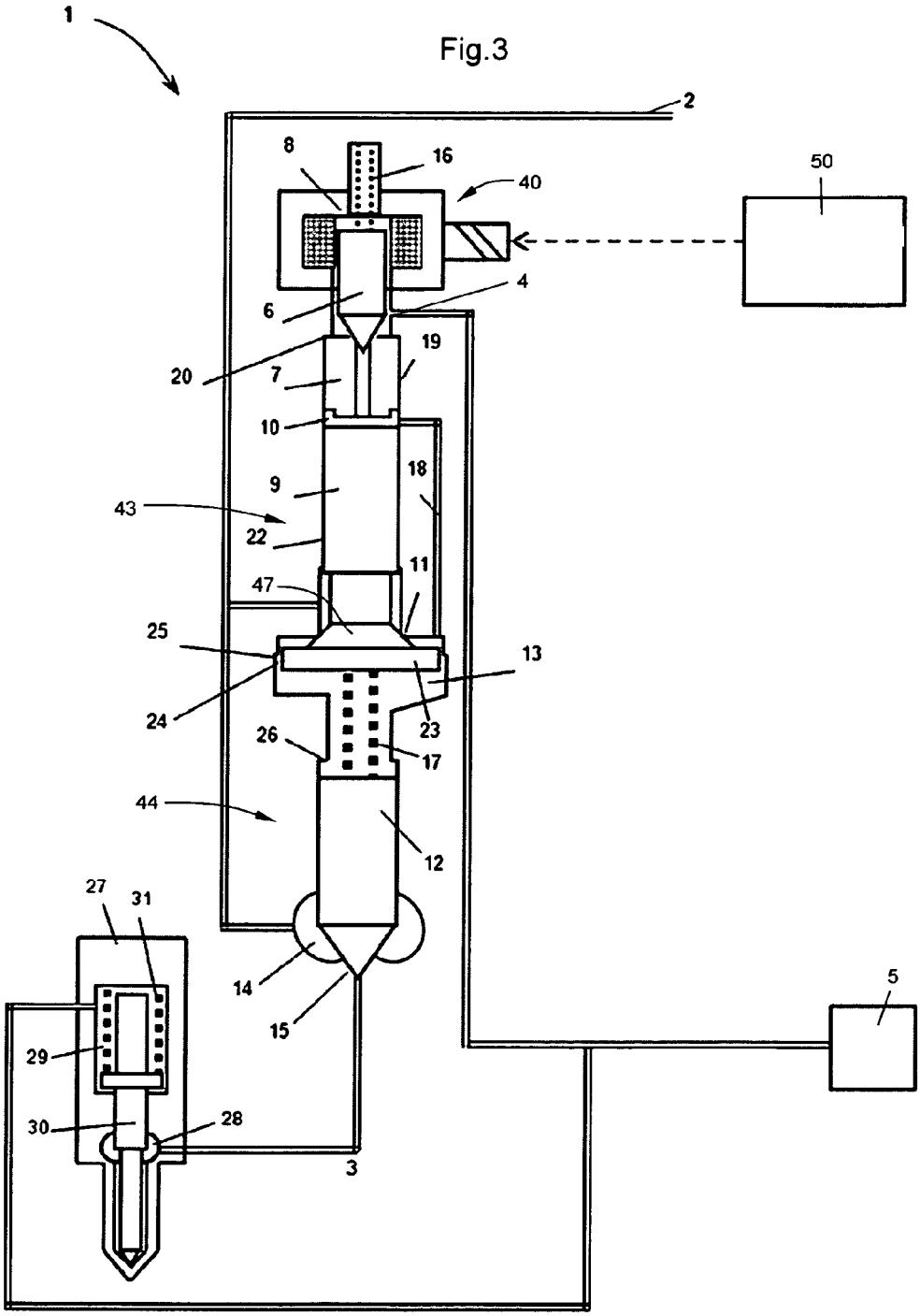
FIG. 3 schematically shows a second embodiment of the flow control system.

In another embodiment shown in FIG. 3, the system is designed similarly to the embodiments described above, but a spring-closed nozzle 27 is connected by the nozzle inlet 28 to the outlet 3. The invention according to this embodiment works in a similar way, but the addition of the nozzle 27 allows some extra tuning of the hydraulic characteristics of the flow control system 1, such as for example increasing the ramp rate of the leading edge of the flow curve.

Figure 4:
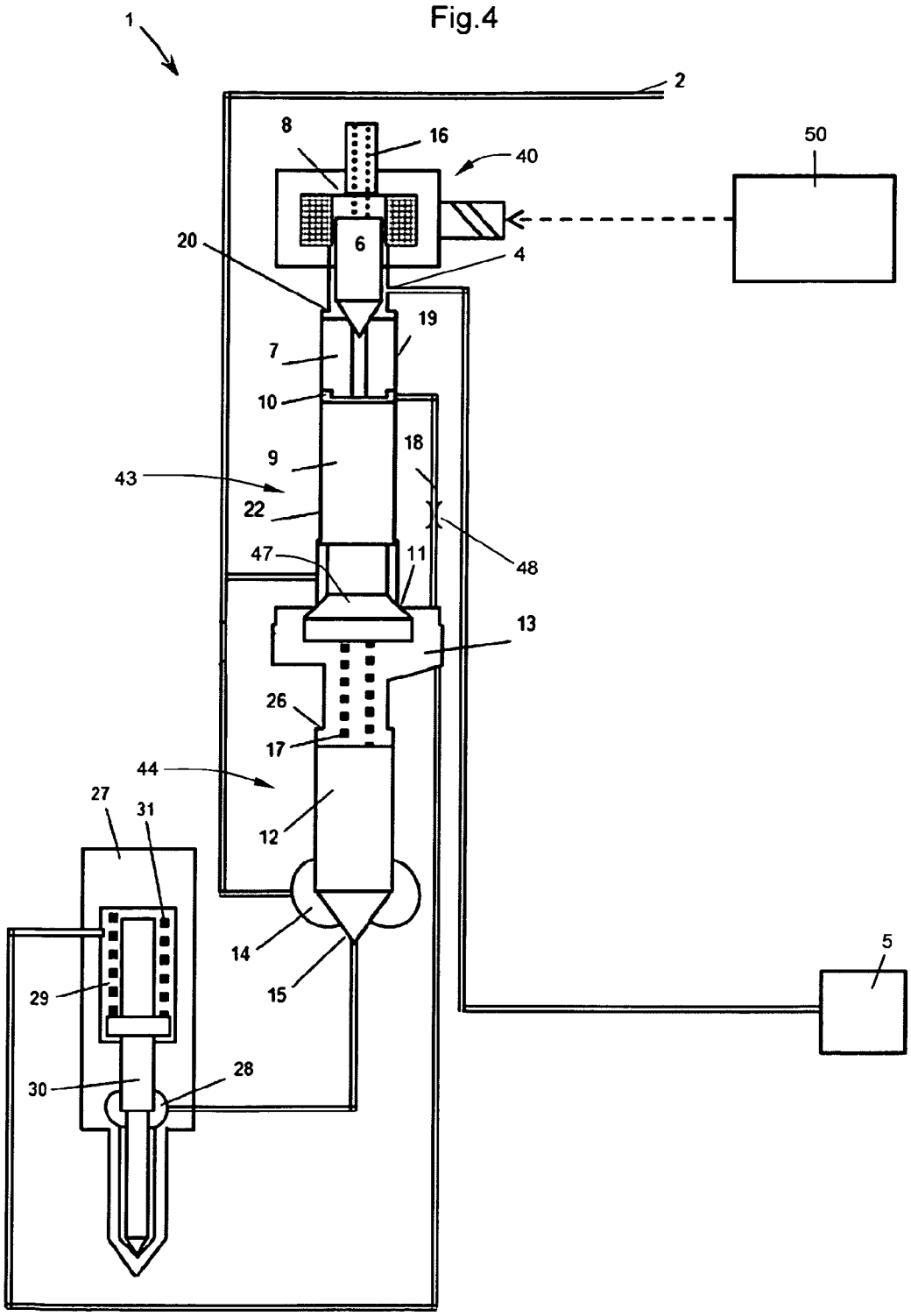
FIG. 4 schematically shows a third embodiment of the flow control system.

Yet another embodiment of the invention, as shown in FIG. 4, differs from the embodiment as shown in FIG. 3 in that the needle control chamber 29 of the nozzle 27 is configured to take part in the flow control, by connecting said needle control chamber to the main control chamber 13. The system then works in the similar way as the embodiments shown in FIGS. 1-3, but the needle 30 of the nozzle 27 is additionally acted upon by the pressure in the main control chamber 13, allowing faster response times and/or reduction of the dimensions of the spring 31 of the nozzle 27. Other variations of that control approach are possible, for instance by connecting the nozzle control chamber 29 to the shuttle control chamber 10 instead of the main control chamber 13.

In FIG. 4, a possible variant of the flow control system is also illustrated, in which a fixed hydraulic restriction 48 is arranged in the connection channel 18, replacing the poppet restriction 24 as shown in the other figures. The flow control system then functions in a similar way to that described above, but it may be made simpler and cheaper.

Figure 5:
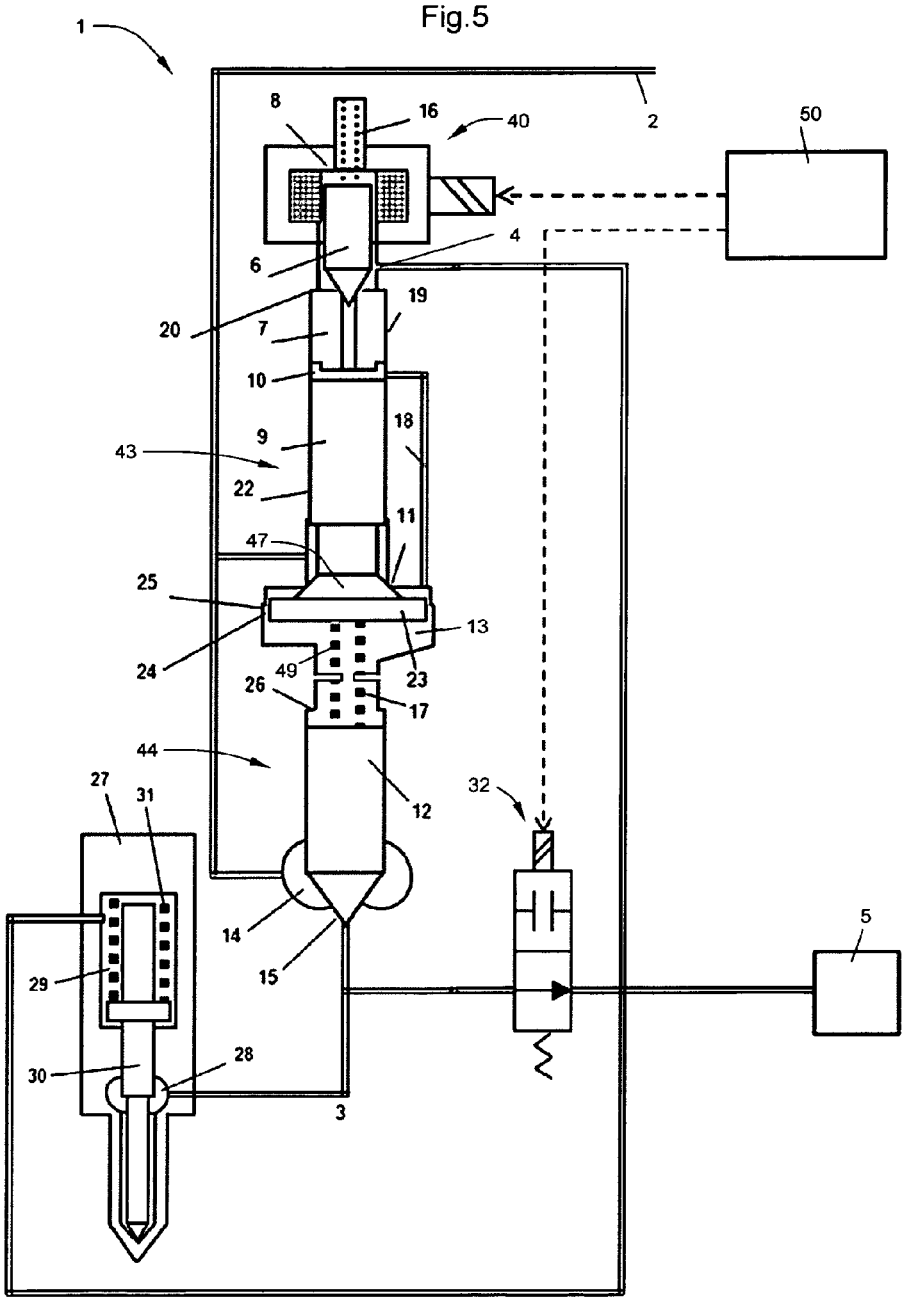
FIG. 5 schematically shows a fourth embodiment of the flow control system.

Still another embodiment of the invention is shown in FIG. 5, in which a spill valve 32 is connected between the outlet 3 of the flow control system 1 and the volume 5 having a relatively low pressure. The spill valve 32 may be open after termination of the controlled fluid flow by the flow control system, such that the inlet of the nozzle 27 can be kept relieved of pressure until next opening of the main control valve 44, in order to prevent possible undesired leakage through the nozzle that might lose its hydraulic tightness due to wear or other damage of the seat of the needle 30.

Figure 6:
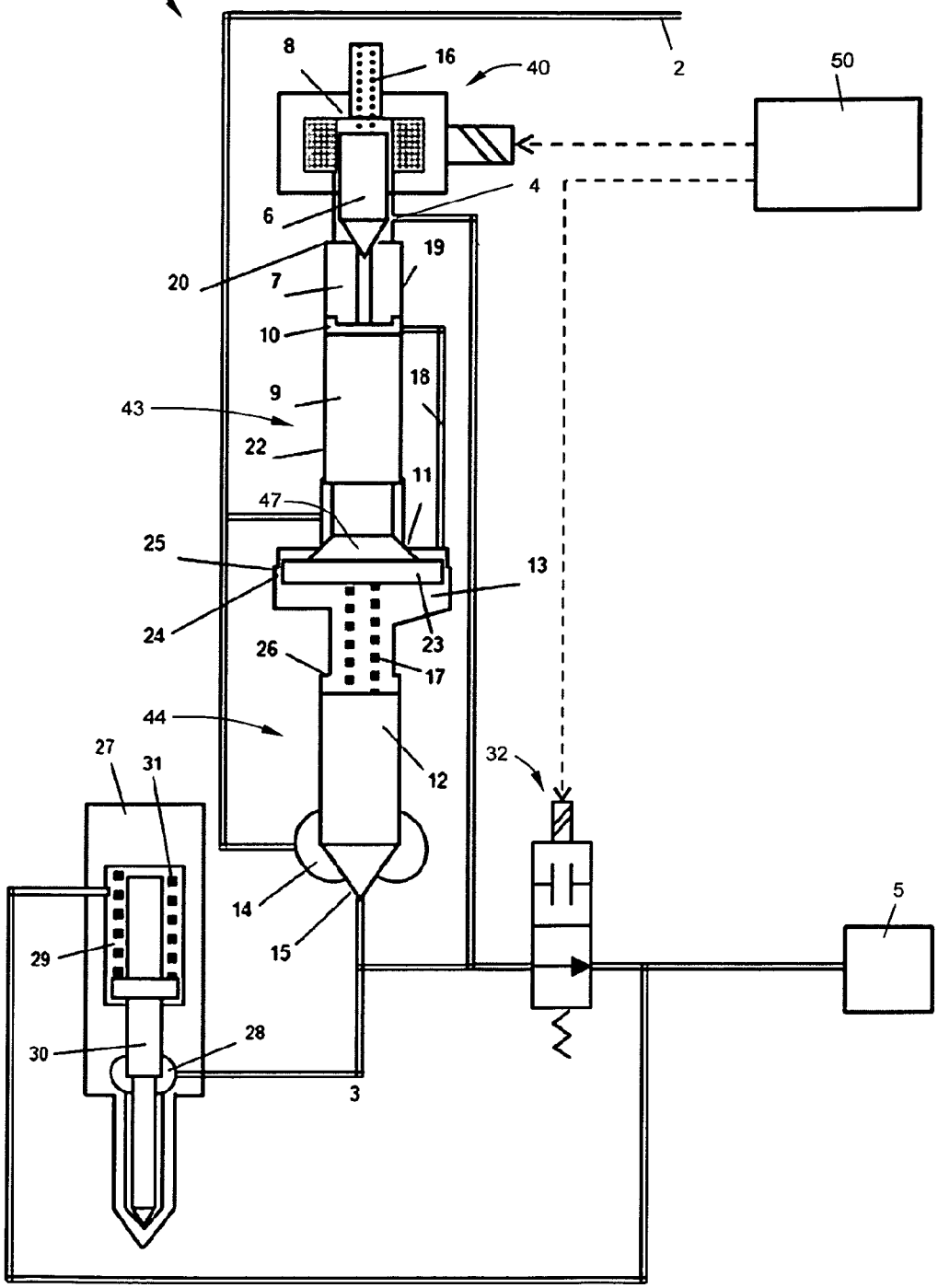
FIG. 6 schematically shows a fifth embodiment of the flow control system.

Yet another embodiment of the invention is shown in FIG. 6, in which the return port 4 is connected to the outlet 3 and the spill valve 32 is connected between the outlet 3 and the volume 5. This embodiment can be controlled for improved hydraulic efficiency, by way of closing the spill valve 32 before the control valve 40 is open to begin the controlled fluid flow. This would reduce the leakage out to said volume 5, and instead direct the pressurised flow relieved by the control valve 40 in the beginning of the system opening from the shuttle control chamber 10 and the main control chamber 13, into the inlet 28 of the nozzle 27, so that less hydraulic energy from the outlet chamber 14 of the main valve 44 would then be used to pressurize the nozzle inlet 28. In this embodiment, the main valve 44 is kept open during the open position of the control valve 40 by the positive pressure difference between the pressure in the outlet 14 of the main valve 44, and the pressure at the outlet 3, which occurs due to the throttling effect in the second seat 15 of the main valve 44.

The embodiments of the flow control system described above are particularly suitable for use in the common rail type of injectors for delivering either ordinary diesel fuel oil or a low-viscosity diesel fuel, such as DME.

Variations of the fuel system according to the invention, as illustrated by the different embodiments, should not be interpreted as limited to exactly said embodiments, but said variations may be applied to other embodiments as well when not inconsistent with each other.

Reference numerals used in the claims should not be seen as limiting the extent of the matter protected by the claims, and their sole function is to make claims easier to understand.

The preferred embodiments of the invention would feature electrically operated control valves 40, 32, which in the majority of applications would be most efficiently realised in the form of solenoid-actuated valves. However, for cost reduction or other reasons, other kinds of control valves may just as well be used in the invention.

As will be realised, the invention is capable of modification in various obvious respects, all without departing from the scope of the appended claims.

Accordingly, the drawings and the description thereto are to be regarded as illustrative in nature, and not restrictive.

The invention claimed is:

1. A flow control system, in particular for a fuel injector for an internal combustion engine, the flow control system comprising:

an inlet port for receiving a fluid having a relatively high pressure, an outlet for letting out the pressurized fluid, a return port for returning part of the fluid to a volume having a relatively low pressure, a 2-way control valve comprising a control valve member, a first seat, a first resilient means configured to force the control valve member towards the seat so as to close the control valve, and a first abutment that limits the lift of the control valve member away from the first seat, a main valve comprising a main valve member, a second seat, a main control chamber, and an outlet chamber in fluid connection with the inlet port, the main valve member being configured to be forced by pressure in the main control chamber towards the second seat so as to close an opening to the outlet, a shuttle valve comprising a shuttle valve body, a shuttle control chamber and a third seat, the shuttle valve body being configured to engage with the third seat so as to close an opening between the inlet port and the main control chamber;

a connection channel configured to connect the shuttle control chamber with the main control chamber, wherein the control valve is configured to close and open a connection between the shuttle control chamber and the return port and is biased towards its closed position by the first resilient means, the shuttle valve is biased closed by a second resilient means, the main valve is configured to open and close a connection between the inlet port and the outlet and is biased closed by the second resilient means, further wherein the shuttle valve is configured such that the pressure in the shuttle control chamber tends to open the shuttle valve whereas the pressure in the main control chamber tends to close the shuttle valve, wherein the main valve is configured such that the pressure in the main control chamber tends to close the main valve whereas a pressure in the outlet chamber tends to open the main valve, wherein the first seat of the control valve is slidably arranged in the shuttle control chamber and wherein an end stop for the first seat is provided such that the pressure in the shuttle control chamber tends to move the first seat towards the end stop, further wherein the first seat, upon its mechanical contact with the valve member, is able to transmit at least a part of the force of the resilient means onto the shuttle valve body in the opening direction of the shuttle valve.

2. A glow control system according to claim 1, wherein the first seat is formed in the shape of a cylinder and is precision-matched to a corresponding guide surface of the shuttle control chamber for reduced leakage through the clearance between the first seat and the guide surface (19).

3. A flow control system according to claim 1, wherein a seating surface is provided in the contact area between the first seat and the end stop, the seating surface being configured to function as a hydraulic seal between the shuffle control chamber and the return port.

4. A flow control system according to claim 1, wherein the shuttle valve is provided with a differential area configured such that positive pressure at inlet tends to open the shuttle valve.

5. A flow control system according to claim 1, wherein the shuttle valve body is provided with a poppet placed between the third seat and the main control chamber.

6. A flow control system according to claim 1, wherein a hydraulic restriction is provided in the channel.

7. A flow control system according to claim 1, wherein the poppet is provided with a poppet hydraulic restriction, wherein the poppet restriction provides a hydraulic restriction between the main control chamber and the shuttle control chamber.

8. A flow control system according to claim 7, wherein the poppet restriction is configured to be variable depending on the position of the shuttle valve body.

9. A flow control system according to claim 8, wherein the poppet restriction is at its maximum when the shuttle valve is at or around its closed position.

10. A flow control system according to claim 1, wherein the main valve is provided with a lift stop.

11. A flow control system according to claim 1, wherein a third resilient means is used to bias closed the shuttle control valve, instead of the second resilient means.

12. A flow control system according to claim 1, wherein the outlet for pressurized fluid is connected to at least one fuel injection orifice for delivery of fuel into combustion chamber of an internal combustion engine.

13. A flow control system according to claim 1, wherein the outlet for pressurized fluid is connected to the inlet of an ordinary spring-closed fuel injection nozzle.

14. A flow control system according to claim 1, wherein the outlet for pressurized fluid is connected to the inlet of a fuel injection nozzle, wherein the fuel injection nozzle has a needle with a needle control chamber, a needle seat and a nozzle spring that biases the needle towards the needle seat to close the fuel injection nozzle.

15. A flow control system according to claim 14, wherein the needle control chamber is in fluid communication with the main control chamber.

16. A flow control system according to claim 14, wherein the needle control chamber is in fluid communication with the shuttle control chamber.

17. A flow control system according to claim 1, wherein a spill valve is installed between the outlet for pressurized fluid and the volume.

18. Fuel injector for an internal combustion engine, the fuel injector comprising a flow control system according to claim 1.

* * * * *